US011603732B2

(12) United States Patent
Homero Thome Ferreira et al.

(10) Patent No.: US 11,603,732 B2
(45) Date of Patent: Mar. 14, 2023

(54) METHOD OF INSERTING A DEVICE IN A SUBSEA OIL WELL, METHOD OF REMOVING A DEVICE FROM A SUBSEA OIL WELL, AND SYSTEM FOR INSERTION AND REMOVAL OF A DEVICE IN A SUBSEA OIL WELL

(71) Applicant: PETRÓLEO BRASILEIRO S.A.—PETROBRAS, Rio de Janeiro (BR)

(72) Inventors: Lincoln Homero Thome Ferreira, Rio de Janeiro (BR); Ney Robinson Salvi Dos Reis, Rio de Janeiro (BR); Igor Mendes-Ursine Krettli, Rio de Janeiro (BR); Hugo Francisco Lisboa Santos, Rio de Janeiro (BR); Hardy Leonardo Da Cunha Pereira Pinto, Rio de Janeiro (BR); Mauricio Galassi, Rio de Janeiro (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 16/630,137

(22) PCT Filed: Jul. 13, 2018

(86) PCT No.: PCT/GB2018/052000

§ 371 (c)(1),
(2) Date: Jan. 10, 2020

(87) PCT Pub. No.: WO2019/012294

PCT Pub. Date: Jan. 17, 2019

(65) Prior Publication Data

US 2020/0165890 A1 May 28, 2020

(30) Foreign Application Priority Data

Jul. 13, 2017 (BR) ..... 102017015062-3

(51) Int. Cl.
*E21B 33/076* (2006.01)
*E21B 23/00* (2006.01)

(52) U.S. Cl.
CPC ..... *E21B 33/076* (2013.01); *E21B 23/00* (2013.01); *E21B 23/001* (2020.05)

(58) Field of Classification Search
CPC ..... E21B 33/076; E21B 23/00; E21B 23/001
See application file for complete search history.

(56) References Cited

U.S. PATENT DOCUMENTS 3,638,722 A * 2/1972 Talley, Jr. ..... E21B 33/038 166/338
4,331,203 A * 5/1982 Kiefer ..... E21B 33/076 166/339

(Continued)

FOREIGN PATENT DOCUMENTS

WO 2011159563 A2 12/2011

OTHER PUBLICATIONS

International Search Report & Written Opinion for PCT/GB2018/052000 dated Nov. 23, 2018.

*Primary Examiner* — James G Sayre
(74) *Attorney, Agent, or Firm* — ArentFox Schiff LLP

(57) ABSTRACT

The present invention relates to methods of inserting and removing tools and/or robots into/from inside subsea oil wells. In this scenario, the present invention provides a system for insertion and removal of a device (30) in a subsea oil well (20), said system comprising (i) a WCT assembly (10) comprising a removable protective cap (40) and (ii) a WCT tool (50) connected to a receptacle (60) comprising within it the device (30), wherein the WCT tool (50) is (Continued)

suitable for being inserted in the place where the protective cap (40) is coupled, wherein at least one of receptacle (60) and WCT tool (50) is able to be opened or closed, releasing the device (30) into the subsea oil well (20) or retaining same inside the receptacle (60). The invention further provides methods of inserting and removing a device (30) into/from a subsea oil well (20).

10 Claims, 4 Drawing Sheets

(56) References Cited

U.S. PATENT DOCUMENTS

| | | | | |
|---|---|---|---|---|
| 6,102,124 | A | 8/2000 | Skeels et al. | |
| 6,112,809 | A | 9/2000 | Angle | |
| 6,378,627 | B1 | 4/2002 | Tubel et al. | |
| 6,446,718 | B1 * | 9/2002 | Barrett | E21B 23/00 166/250.01 |
| 9,328,578 | B2 | 5/2016 | Kumaran et al. | |
| 2002/0139535 | A1 * | 10/2002 | Nice | E21B 33/076 166/344 |
| 2004/0026084 | A1 | 2/2004 | Donald | |
| 2005/0288819 | A1 * | 12/2005 | de Guzman | F16L 55/38 700/245 |
| 2006/0231263 | A1 | 10/2006 | Boyce et al. | |
| 2011/0005766 | A1 | 1/2011 | Shand | |
| 2011/0240303 | A1 * | 10/2011 | Hallundbaek | B63C 11/42 166/339 |
| 2015/0337632 | A1 | 11/2015 | Dahlem et al. | |
| 2016/0047209 | A1 | 2/2016 | Castillo et al. | |

* cited by examiner

METHOD OF INSERTING A DEVICE IN A SUBSEA OIL WELL, METHOD OF REMOVING A DEVICE FROM A SUBSEA OIL WELL, AND SYSTEM FOR INSERTION AND REMOVAL OF A DEVICE IN A SUBSEA OIL WELL

CROSS-REFERENCE TO RELATED APPLICATION

This application claims the benefit of priority to BR 10 2017 015062-3, filed 13 Jul. 2017, which is incorporated herein by reference in its entirety.

FIELD OF THE INVENTION

The present invention relates to methods of inserting and removing tools and/or robots into/from inside subsea oil wells.

BACKGROUND OF THE INVENTION

It is widely known in the prior art that petroleum and natural gas are extracted from porous rocks located hundreds to thousands of metres underground. For draining them, production units, called wells, are constructed. This construction is carried out using special vessels for this purpose, called rigs.

These vessels carry out drilling of the wells and, next, they position steel pipes, called casing pipes, between the formation and the interior of the well to ensure integrity of the system. Finally, various equipment is installed inside the well, such as safety valves, control valves, pumping systems, among others. The purpose of this equipment is to guarantee controlled, safe production in the well.

However, these wells are not able to produce uninterruptedly throughout their useful life. It may be necessary to carry out maintenance operations. This type of operation is called workover. Some common reasons for carrying out these operations are failure in some equipment, holes in the production string, restrictions due to scale, increased production of water or gas, production of sand, etc.

In the present state of the art, these maintenance operations on wells are carried out using dedicated rigs.

For carrying out these maintenance operations, first planning of the intervention is carried out. After this step, the rigs are moved to the well and positioned above it, either using anchors, or by dynamic positioning systems. Then the rig removes the cap from the Christmas tree, also known as tree cap.

Next, a set of pipes is lowered, called risers, joined to the Christmas tree tool so that wire tools (slickline tools), cable tools, also called wireline tools, or flexitube tools, also called coiled tubing tools are lowered inside the riser. These tools carry out the maintenance operations in the well.

The main problem of this approach is the cost, since the daily rates for the rigs are quite high, especially in the offshore environment. Furthermore, for carrying out these interventions it is necessary to wait until the rig is available, something that may take months, so that from the fault to the repair, these wells are kept closed or with reduced production, which may generate a relatively high loss of production in high-productivity wells.

In an attempt to solve the problem described above, document WO2011159563A2 provides a system for carrying out underwater operations. The system comprises service apparatus supported on a floating unit, dispensing with the need for a rig for service operations in subsea wells. However, there will still be dependence on a floating vessel throughout the workover operation in the well.

In order to eliminate the need for any vessel dedicated to the workover operation throughout its duration, resident autonomous robots are used in the wells for carrying out the necessary maintenance operations. The robot remains inside the well throughout its useful life, and is only removed or replaced in case of breakdown. Document U.S. Pat. No. 6,378,627B1, for example, discloses autonomous equipment for oil wells comprising (a) a body to be positioned in a well; (b) a source of electric power; (c) at least one sensor for monitoring at least one parameter; (d) a microprocessor receiving data from the sensor; (e) a memory connected to the microprocessor; (f) a transport mechanism controlled by the microprocessor for moving the body of the equipment inside the well; (g) a working end for carrying out operations inside the well. The autonomous equipment is controlled remotely for performing the maintenance tasks or data collection inside the well.

However, since the equipment in document U.S. Pat. No. 6,378,627B1 is permanently resident in the wells, it is necessary for each well to have its own robot, meaning that the costs are high, compared to the use of rigs for the interventions.

As will be presented in more detail below, the present invention aims to solve the problems of the prior art described above in a practical and efficient manner.

SUMMARY OF THE INVENTION

The present disclosure aims to provide methods of inserting and removing a device in a subsea oil well that dispenses with the need for a rig dedicated to this service.

Also disclosed are methods of inserting and removing a device, such as an autonomous device, in a subsea oil well so as to enable one and the same device to perform maintenance tasks in different subsea oil wells, dispensing with the need for a device resident inside the well.

The present disclosure provides a method of inserting a device, such as an autonomous device, in a subsea oil well, said method comprising the steps of (i) removing a protective cap from a wet Christmas tree (WCT) assembly, (ii) inserting a WCT tool in the place where the protective cap was previously coupled, wherein the WCT tool is connected to a receptacle comprising within it the device and (iii) opening at least one of receptacle and WCT tool so as to release the autonomous device into the subsea oil well.

Optionally, the receptacle comprises a shape corresponding to the shape of the device.

Optionally, at least one of the receptacle and the WCT tool is configured for being opened and closed.

Optionally the method further comprises the step of transporting a combination of the WCT tool and the receptacle comprising the device between the sea surface and the sea bed by means of a support vessel and/or a ROV.

Optionally the method further comprises removing the WCT tool from the WCT assembly after the device is released into the subsea oil well.

Optionally, the method comprises replacing the protective cap on the WCT assembly after WCT tool has been removed.

Optionally, both the receptacle and the WCT tool are configured to be opened and closed, and wherein the step of opening comprises opening both the receptacle and the WCT tool.

In addition, the present disclosure provides a method for removing a device, such as an autonomous device, from a subsea oil well, said method comprising the steps of (i) removing a protective cap from a wet Christmas tree (WCT) assembly, (ii) inserting a WCT tool in the place where the protective cap was previously coupled, wherein the WCT tool is connected to a receptacle suitable for receiving within it the device and (iii) guiding the autonomous device from inside the subsea oil well to the receptacle.

Optionally, the receptacle comprises a shape corresponding to the shape of the device.

Optionally, at least one of receptacle and WCT tool is configured for being opened and closed.

Optionally, the method further comprises the step of transporting a combination of the WCT tool and the receptacle comprising the device between the sea surface and the sea bed by means of a support vessel and/or a ROV.

Optionally, the method further comprises the step of disconnecting a combination of the WCT tool and the receptacle comprising the device from the WCT assembly.

Moreover, the present disclosure provides a system for insertion and removal of a device, such as an autonomous robotic device, in a subsea oil well, said system comprising (i) a WCT assembly comprising a removable protective cap and (ii) a WCT tool connected to a receptacle comprising within it the device, wherein the WCT tool is suitable for being inserted in the place where the protective cap is coupled, wherein at least one of the receptacle and the WCT tool is able to be opened or closed, to release the device into the subsea oil well or to retain the device inside the receptacle.

Optionally the device comprises at least one set of expandable arms.

Optionally, the device comprises a central body and four sets of expandable arms, wherein two sets of expandable arms are positioned at a first end of the central body, and two sets of expandable arms are positioned at a second end of the central body.

Optionally, each set of expandable arms comprises three expandable arms.

Optionally, each expandable arm is configured as an elastic body of the spring type.

Optionally, each expandable arm comprises two elastic elements joined together at a central point.

Optionally, a sliding wheel is positioned at the central point.

Optionally, the system further comprises a support for the sliding wheel, and wherein the elastic elements are fixed to the support.

Optionally, each elastic element comprises a spring element with double kink and straight middle.

Optionally, the sliding wheels are positioned to be inclined relative to an axis of motion of the device.

Optionally, the inclined wheels are configured to produce a helicoidal or bi-helicoidal motion of the device inside the subsea oil well.

There is also disclosed an apparatus for use during insertion of a device in a subsea oil well via a wet Christmas tree (WCT) assembly comprising a removable protective cap, or during removal of the device therefrom, the apparatus comprising: a WCT tool configured to be inserted in the place where the protective cap of the WCT assembly is coupled, and a receptacle, connected to the WCT tool, for storing the autonomous device, wherein at least one of receptacle and WCT tool is able to be opened or closed, to release the device into the subsea oil well or to retain the WCT tool inside the receptacle.

According to a first aspect there is a method of inserting an autonomous device (30) in a subsea oil well (20), characterized in that it comprises the steps of: removing a protective cap (40) from a WCT assembly (10); inserting a WCT tool (50) in the place where the protective cap (40) was previously coupled, wherein the WCT tool (50) is connected to a receptacle (60) comprising within it the autonomous device (30); and opening at least one of receptacle (60) and WCT tool (50) so as to release the autonomous device (30) into the subsea oil well (20).

According to a second aspect there is a method according to the first aspect, characterized in that the receptacle (60) comprises a shape corresponding to the shape of the autonomous device (30).

According to a second aspect there is a method according to the first or second aspect, characterized in that at least one of receptacle (60) and WCT tool (50) is configured for being opened and closed.

According to a second aspect there is a method according to any one of the first to third aspects, characterized in that it additionally comprises the step of transporting the assembly formed by the WCT tool (50) and the receptacle (60) comprising the autonomous device (30) between the sea surface and the sea bed by means of at least one of support vessel and ROV.

According to a fifth aspect there is a method of removing an autonomous device (30) from a subsea oil well (20), characterized in that it comprises the steps of: removing a protective cap (40) of a WCT assembly (10); inserting a WCT tool (50) in the place where the protective cap (40) was previously coupled, wherein the WCT tool (50) is connected to a receptacle (60) suitable for receiving within it the autonomous device (30); and guiding the autonomous device (30) from inside the subsea oil well (20) to the receptacle (60).

According to a sixth aspect there is a method according to the fifth aspect, characterized in that the receptacle (60) comprises a shape corresponding to the shape of the autonomous device (30).

According to a seventh aspect there is a method according to the fifth or sixth aspect, characterized in that at least one of receptacle (60) and WCT tool (50) is configured for being opened and closed.

According to an eighth aspect there is a method according to any of the fifth to seventh aspects, characterized in that it additionally comprises the step of transporting the assembly formed by the WCT tool (50) and by the receptacle (60) comprising the autonomous device (30) between the sea surface and the sea bed by means of at least one of support vessel and ROV.

According to a ninth aspect there is a method according to any of the fifth to eighth aspects, characterized in that it additionally comprises the step of disconnecting the assembly formed by the WCT tool (50) and the receptacle (60) comprising the autonomous device (30) from the WCT assembly (10).

According to a tenth aspect there is a system for insertion and removal of an autonomous device (30) in a subsea oil well (20), characterized in that it comprises: a WCT assembly (10) comprising a removable protective cap (40); and a WCT tool (50) connected to a receptacle (60) comprising within it the autonomous device (30), wherein the WCT tool (50) is suitable for being inserted in the place where the protective cap (40) is coupled, wherein at least one of receptacle (60) and WCT tool (50) is able to be opened or closed, releasing the autonomous device (30) into the subsea oil well (20) or retaining same inside the receptacle (60).

According to an eleventh aspect there is a system according to the tenth aspect, characterized in that the autonomous device (30) comprises at least one set (9) of expandable arms (1), wherein each set (9) of expandable arms (1) comprises three expandable arms (1).

According to a twelfth aspect there is a system according to the tenth or eleventh aspect, characterized in that it comprises four sets (9) of expandable arms (1) each with three expandable arms (1), wherein two sets (9) of expandable arms (1) are positioned before a central body (5), and two sets (9) of expandable arms (1) are positioned after the tool (5).

According to a thirteenth aspect there is a system according to the eleventh or twelfth aspect, characterized in that the expandable arm (1) is an elastic element of the spring type.

According to a fourteenth aspect there is a system according to any one of the eleventh to thirteenth aspects, characterized in that the expandable arm comprises two elastic elements (11) joined together at a central point, wherein a sliding wheel (2) is positioned at the central point.

According to a fifteenth aspect there is a system according to the fourteenth aspect, characterized in that it comprises a support (3) for the sliding wheel (2), wherein the elastic elements (11) are fixed to the support (3).

According to a sixteenth aspect there is a system according to the fourteenth or fifteenth aspect, characterized in that each elastic element (11) comprises a spring element with double kink and straight middle.

According to a seventeenth aspect there is a system according to any one of the fourteenth to sixteenth aspects, characterized in that the sliding wheels (2) are positioned so that they are inclined relative to an axis of motion of the autonomous device (30), wherein the inclined wheels are configured for producing a helicoidal or bi-helicoidal motion of the autonomous device (30) inside the subsea oil well (20).

BRIEF DESCRIPTION OF THE FIGURES

The detailed description presented hereunder refers to the appended figures and their respective reference numbers.

DETAILED DESCRIPTION OF THE INVENTION

To begin with, it is emphasized that the following description is based on a preferred embodiment. However, as will be obvious to a person skilled in the art, the invention is not limited to this particular embodiment.

Figure 1:
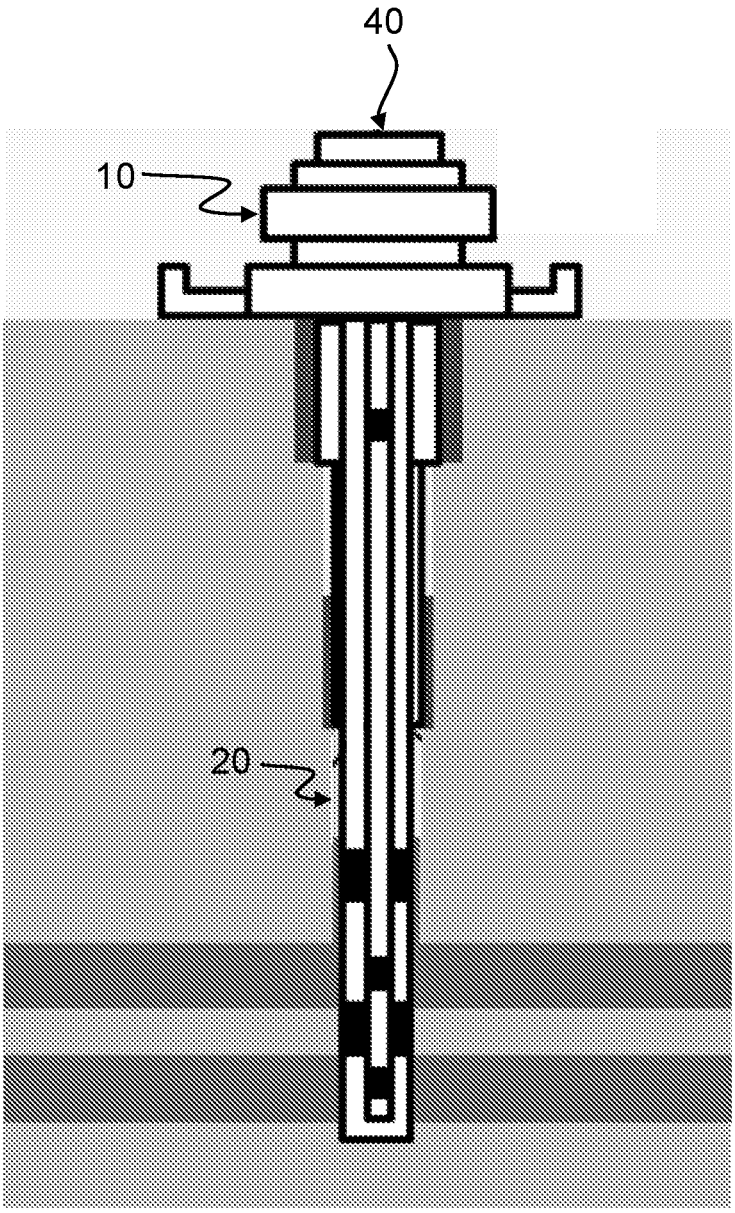
FIG. 1 shows a sectional view of a WCT assembly and of a subsea oil well where the methods according to the preferred embodiment are applied.

FIG. 1 shows a sectional view of a wet Christmas tree (WCT) assembly 10 and of a subsea oil well 20 where the methods according to the preferred embodiment are applied.

Firstly, a method of inserting a device, such as an autonomous device 30, in the subsea oil well 20 is provided. A first step of the method according to the preferred embodiment consists of removing a protective cap 40 (known as tree cap) from the WCT assembly 10.

In a second step of the method of insertion, a WCT tool 50 (known as tree running tool), or some other equivalent interface tool, is inserted in the place where the protective cap 40 was previously coupled. The insertion of the WCT tool 50 may comprise coupling the WCT tool 50 to the WCT assembly 10 in the same way that the protective cap 40 was coupled.

Figure 2:
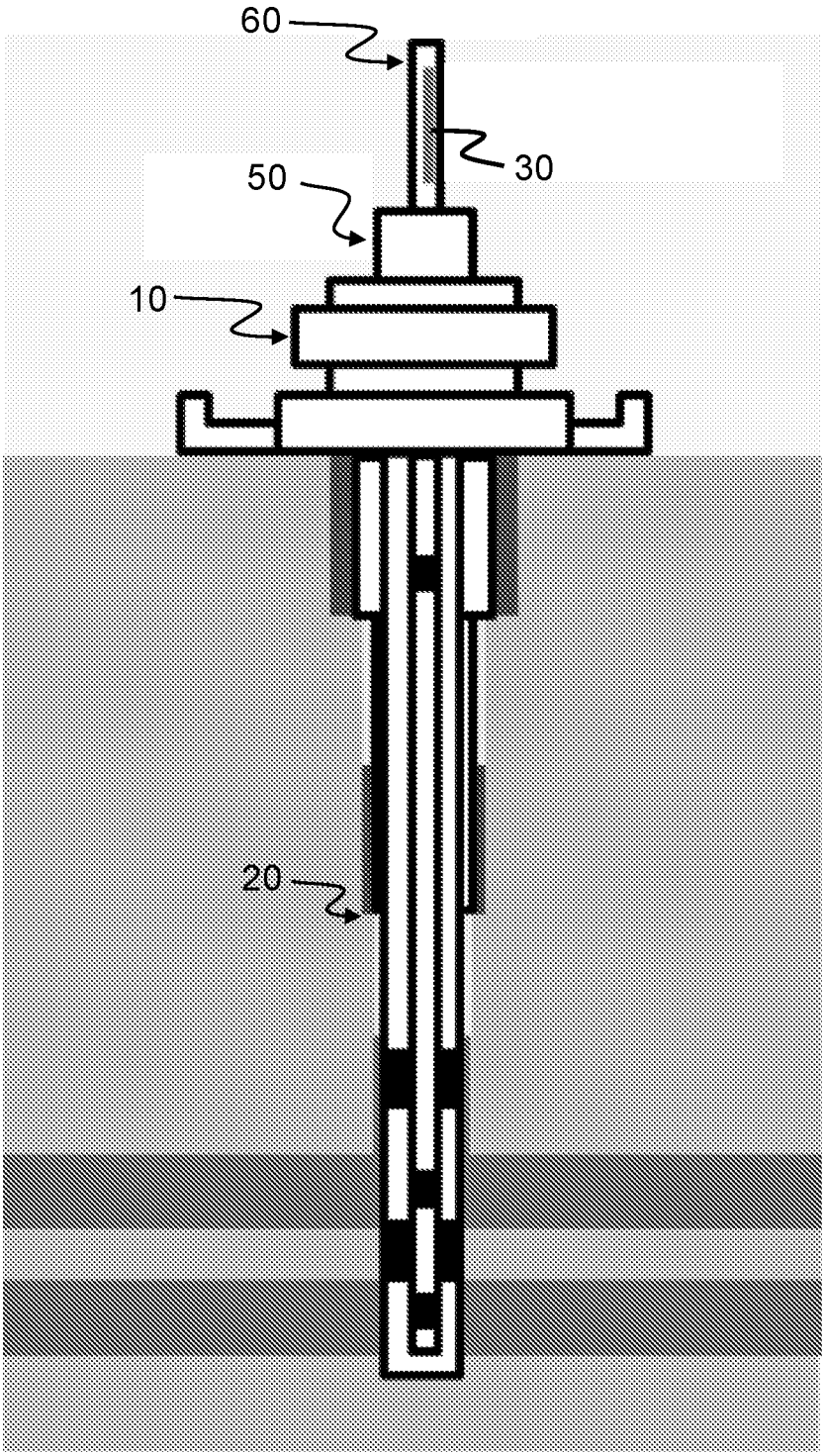
FIG. 2 shows the view in FIG. 1 additionally showing a WCT tool connected to a receptacle comprising within it an autonomous device.

Preferably, the WCT tool 50 is connected to a receptacle 60 suitable for receiving within it the autonomous device 30. Preferably, the receptacle 60 comprises a shape corresponding to the shape of the autonomous device 30. In the example shown in FIG. 2 the receptacle 60 and the autonomous device 30 have an elongated shape.

Preferably, the receptacle 60 is able to be opened and closed. More preferably, the bottom end of the receptacle 60 is a closable opening through which the autonomous device 30 passes.

Optionally, the WCT tool 50 is able to be opened and closed, allowing or not allowing passage of the autonomous device 30.

In a third step of the method of insertion, the receptacle 60 and/or WCT tool 50 is opened so as to release the autonomous device 30 into the subsea oil well 20. If both the receptacle 60 and the WCT tool 50 are able to be opened and closed, then both can be opened in this step.

Once the device 30 has been released, it may be preferable to remove the WCT tool 50 and to replace the protective cap 40.

There is further provided a method of removing a device, such as the autonomous device 30, from the subsea oil well 20. A first step of the method of removal according to the preferred embodiment also consists of removing the protective cap 40 from the WCT assembly 10, assuming it has been replaced after the device was introduced. If the WCT tool 50 with the associated receptacle 60 is still attached, this step and the second step mentioned below may be omitted.

In a second step of the method of removal, the WCT tool 50 or some other equivalent interface tool is inserted in the place where the protective cap 40 was previously coupled.

Preferably, the WCT tool 50 is connected to the empty receptacle 60, which is suitable for receiving within it the autonomous device 30.

Finally, the device 30 is guided from inside the subsea oil well 20 to the receptacle 60. If the device is fully autonomous, the step of guiding may happen automatically (i.e. the device 30 may guide itself). Alternatively, the device 30 may be remotely guided by an operator.

Optionally, the receptacle 60 is closed with the autonomous device 30 inside it. Also optionally, the WCT tool 50 is closed, so as to confine the autonomous device 30 in the receptacle 60 even when the receptacle 60 itself is open.

Preferably, the combination or assembly formed by the WCT tool 50 and the receptacle 60 comprising the autonomous device 30 is transported between the sea surface and the sea bed by a support vessel and/or an ROV (Remotely Operated Vehicle).

There is further provided a system for insertion and removal of a device such as an autonomous device 30 in the subsea oil well 20. The system comprises a WCT assembly 10 comprising a removable protective cap 40 and a WCT tool 50 connected to a receptacle 60 comprising within it the autonomous device 30, wherein the WCT tool 50 is suitable for being inserted in the place where the protective cap 40 is coupled.

In the present system, at least one of receptacle 60 and WCT tool 50 is able to be opened or closed, releasing the autonomous device 30 into the subsea oil well 20 or retaining same inside the receptacle 60, depending on the method (insertion or removal) that is being executed.

Figure 3:
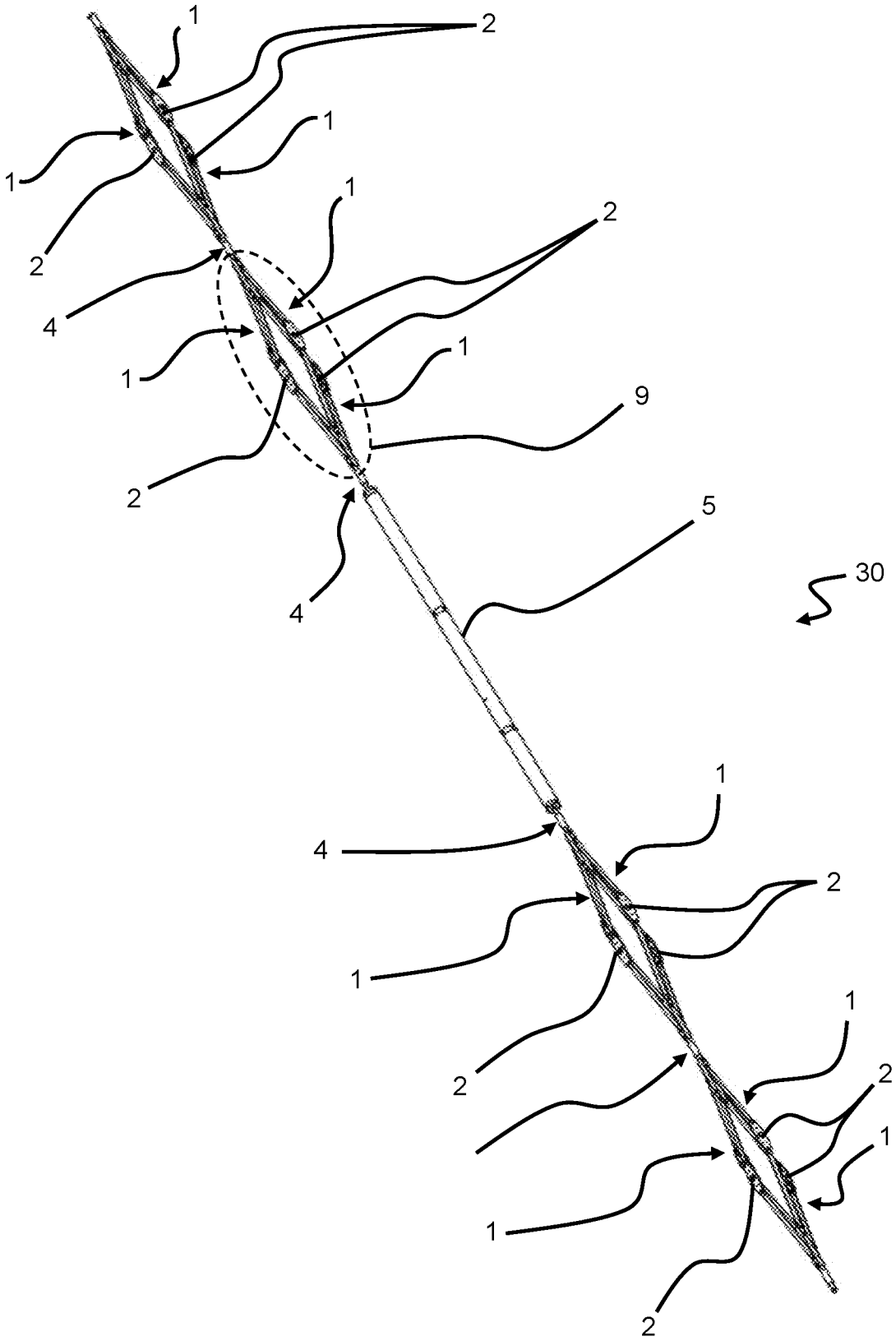
FIG. 3 shows a preferred configuration of the autonomous device.

Preferably, the device is an autonomous device 30 such as an autonomous robot suitable for performing workover operations inside the subsea oil well 20, as illustrated in FIG. 3.

Figure 4:
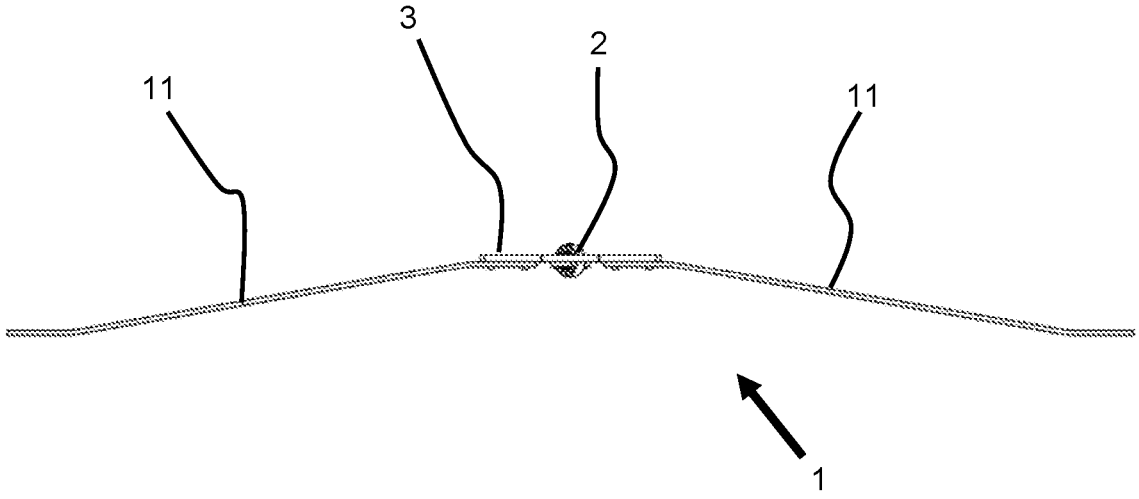
FIG. 4 shows an isolated view of an expandable arm according to an optional configuration of an autonomous device.

As can be seen in FIGS. 3 and 4, the autonomous device 30 comprises a central body 5 and expandable arms 1. Each expandable arm 1 comprises at least one sliding wheel 2 configured for touching the inside wall of a pipeline.

Optionally, the autonomous device 30 comprises at least one set 9 of expandable arms 1. Each set 9 can comprise three expandable arms 1, for example. The configuration with three expandable arms 1 may be advantageous through allowing better centering thereof, in comparison with other configurations.

In any one of the configurations described, each expandable arm 1 comprises at least one sliding wheel 2 configured for touching the inside wall of the pipeline. In this way, when a configuration with three expandable arms 1 is adopted, three sliding wheels 2 will be adopted, i.e. one for each expandable arm.

In alternative configurations (not shown in the figures) only one set 9 of expandable arms 1 may be adopted. This may be achieved by providing a central body 5 enclosed by the expandable arms 1. In these configurations, three expandable arms 1 are preferably adopted.

FIG. 4 shows an isolated view of an expandable arm 1 according to an optional configuration; in this configuration, the expandable arm 1 is an elastic body of the spring type. More particularly, the expandable arm 1 comprises two elastic elements 11 joined together at a central point. A sliding wheel 2 can be positioned at the central point. In this configuration, a support 3 for the sliding wheel 2 may also be adopted, wherein the expandable arms 1 would be fixed to the support 3.

In this optional configuration, it can be seen that each elastic element 11 comprises a spring element (of the spring assembly type) with double kink and straight middle. In other words, the elastic element 11 is made from a flexible material that can be compressed and then spring back to its original shape. It is thus possible to achieve a configuration whose profile is reduced to comprise a larger range of diameters.

Optionally, the sliding wheels 2 are positioned so that they are inclined relative to the axis of motion of the central body 5 (or, in use, the central axis of the pipeline), so as to produce a helicoidal motion inside the pipeline.

In optional configurations, as shown in FIG. 3, in which four sets 9 of expandable arms 1 are adopted, e.g. with each set 9 having three arms 1, two sets 9 can be positioned before the central body 5 and two sets 9 can be positioned after the central body 5. In these configurations, all the sliding wheels 2 may be inclined, providing two sets 9 of inclined wheels, both in the front portion and in the rear portion. The central body 5 then follows a bi-helicoidal path as it moves through the pipeline, meaning that its traction capacity is twice as great as that of a conventional robot that performs a helicoidal motion.

In this optional configuration, the sets 9 with three expandable arms 1 are joined at the ends of the expandable arms 1 by connecting elements. These elements may be any known connecting elements.

In addition, a linkage 4 may be adopted, connecting together (at each end) the set 9 of expandable arms 1 closest to the central body 5 to the set 9 further away from the central body 5. This linkage 4 may be rigid or flexible, so as to allow rotational and bending movements.

Thus, there are provided methods and a system that dispense with the need for a dedicated rig for this service. In addition, since the device 30 is not resident, it is able to perform maintenance tasks in different subsea oil wells in a practical manner and at low cost.

Countless variations falling within the scope of protection of the present application are permitted. This reinforces the fact that the present invention is not limited to the configurations/particular embodiments described above. As such, modifications of the above-described apparatuses and methods, combinations between different variations as practicable, and variations of aspects of the invention that are obvious to those of skill in the art are intended to be within the spirit and scope of the claims.

The invention claimed is:

1. A method of inserting an autonomous robotic device in a subsea oil well, wherein the method comprises the steps of:

removing a protective cap from a wet Christmas tree (WCT) assembly;

inserting a WCT tool in the place where the protective cap was previously coupled, wherein the WCT tool is connected to a receptacle comprising within it the autonomous robotic device, wherein the WCT tool is configured to being opened and closed independently from the receptacle; and opening at least one of the receptacle and the WCT tool so as to release the autonomous robotic device into the subsea oil well.

2. The method according to claim 1, wherein the receptacle comprises a shape corresponding to the shape of the autonomous robotic device.

3. The method according to claim 1, wherein the receptacle is configured for being opened and closed.

4. The method according to claim 1, further comprising the step of transporting a combination of the WCT tool and the receptacle comprising the autonomous robotic device between the sea surface and the sea bed by means of a support vessel and/or a ROV.

5. The method according to claim 1, further comprising removing the WCT tool from the WCT assembly after the autonomous robotic device is released into the subsea oil well.

6. The method according to claim 5, further comprising replacing the protective cap on the WCT assembly after the WCT tool has been removed.

7. The method according to claim 6, the method further comprising the steps of:

removing the protective cap of the wet Christmas tree (WCT) assembly;

inserting the WCT tool in the place where the protective cap was previously coupled, wherein the WCT tool is connected to the receptacle suitable for receiving within it the autonomous robotic device; and guiding the autonomous robotic device from inside the subsea oil well to the receptacle.

8. The method according to claim 7, further comprising the step of disconnecting a combination of the WCT tool and the receptacle comprising the autonomous robotic device from the WCT assembly.

9. The method according to claim 1, wherein both the receptacle and the WCT tool are configured to be opened and closed, and wherein the step of opening comprises opening both the receptacle and the WCT tool.

10. An apparatus for use during insertion of an autonomous robotic device in a subsea oil well via a wet Christmas tree (WCT) assembly comprising a removable protective cap, or during removal of the autonomous robotic device therefrom, the apparatus comprising:

a WCT tool configured to be inserted in the place where the protective cap of the WCT assembly is coupled, and a receptacle, connected to the WCT tool, for storing the autonomous robotic device, wherein at least one of the receptacle and the WCT tool is able to be opened or closed independently of each other, to release the autonomous robotic device into the subsea oil well or to retain the autonomous robotic device inside the receptacle.

* * * * *